US006186514B1

(12) United States Patent
Ikeda et al.

(10) Patent No.: US 6,186,514 B1
(45) Date of Patent: Feb. 13, 2001

(54) GASKET FOR SEALING A REFRIGERANT COMPRESSOR

(75) Inventors: Hayato Ikeda; Noriyuki Shintoku; Keishi Nakagaki; Tomohiro Wakita, all of Kariya (JP)

(73) Assignee: Kabushiki Kaisha Toyoda Jidoshokki Seisakusho, Aichi-ken (JP)

( * ) Notice: Under 35 U.S.C. 154(b), the term of this patent shall be extended for 0 days.

(21) Appl. No.: 09/003,020

(22) Filed: Jan. 5, 1998

(30) Foreign Application Priority Data

Jan. 8, 1997 (JP) ..... 9-001193

(51) Int. Cl.[7] ..... F02F 11/00
(52) U.S. Cl. ..... 277/594; 277/639; 277/644
(58) Field of Search ..... 277/637, 639, 277/644, 630, 593, 594, 595; 417/269

(56) References Cited

U.S. PATENT DOCUMENTS 4,226,572 * 10/1980 Nakayama et al. ..... 417/269
4,416,190 * 11/1983 Ishizuka ..... 417/269 X
4,759,556 * 7/1988 Udagawa ..... 277/593
4,834,399 * 5/1989 Udagawa et al. ..... 277/593
5,122,214 * 6/1992 Zurfluh et al. ..... 156/220
5,186,475 * 2/1993 Kawai et al. ..... 277/644 X
5,466,129 * 11/1995 Fukai ..... 417/269

FOREIGN PATENT DOCUMENTS 242874 9/1997 (JP) .

* cited by examiner

*Primary Examiner*—Anthony Knight
*Assistant Examiner*—Alison K. Pickard
(74) *Attorney, Agent, or Firm*—Burgess, Ryan & Wayne; Milton J. Wayne; William R. Moran

(57) ABSTRACT

A gasket having a surface thereof coated with an elastic membrane and adapted to be interposed, together with a valve plate and a discharge valve member, between a cylinder block and a housing of a refrigerant compressor under compression. The gasket includes an outer sealing portion for sealing an outer circumference of the compressor against an atmospheric environment therearound, and an inner sealing portion, connected to the outer sealing portion, for sealing between a high pressure region and a low pressure region within the compressor. Each of the outer and inner sealing portions includes in its entirety a deformable ridge which is shaped as a convexly curved projection with an apex line continuously extending along a length of the each outer and inner sealing portion. When the gasket is located in a proper position in the compressor, the apex lines of the ridges of the respective sealing portions are abutted to the front or rear housing of the compressor.

3 Claims, 4 Drawing Sheets

GASKET FOR SEALING A REFRIGERANT COMPRESSOR

BACKGROUND OF THE INVENTION

1. Field of the Invention

The present invention relates generally to a gasket for sealing a refrigerant compressor and, more particularly, to a metallic gasket covered with an elastic coating and adapted for providing a connecting portion, between a cylinder block and an end housing of a refrigerant compressor, and between high and low pressure regions inside the compressor, with a stable fluid-tight sealing.

2. Description of the Related Art

In conventional refrigerant compressors such as swash plate type refrigerant compressors, a pair of front and rear cylinder blocks are axially combined together to define, inside a joint region of the cylinder blocks, a swash plate chamber in which a refrigerant returning from an external refrigerating system is introduced to be compressed. The opposite ends of the combined front and rear cylinder blocks, located away from each other, are closed by front and rear housings via front and rear valve assemblies.

Each of the front and rear housings is provided with a radially outer suction chamber for the refrigerant gas before compression and a radially inner discharge chamber for the compressed refrigerant gas. The combined front and rear cylinder blocks are provided with a common central shaft bore for receiving therein an axial drive shaft. A swash plate is fixedly mounted on the drive shaft so as to rotate together with the drive shaft within the swash plate chamber. The combined front and rear cylinder blocks are also provided with a plurality of axially extending cylinder bores in which double headed pistons, operatively engaged with the swash plate via shoes, are received. The double headed pistons are reciprocated by the rotating swash plate in the cylinder bores to implement suction and compression of the refrigerant gas, and to discharge the compressed refrigerant gas.

The front and rear valve assemblies include front and rear valve plates, respectively, and a discharge valve member and a suction valve member are combined with each of the front and rear valve plates. Each of the valve plates is provided with plural suction ports bored therein and fluidly connected to the associated suction chamber. The suction ports of each valve plate are openably closed by the suction valve member. Each of the valve plates is also provided with plural discharge ports bored therein and fluidly connected to the associated discharge chamber. The discharge ports of each valve plate are openably closed by the discharge valve member.

The discharge ports of the front and rear valve plates are arranged to be in registration with the cylinder bores of the front and rear cylinder blocks to discharge the compressed refrigerant gas from the cylinder bores toward the front and rear discharge chambers through the discharge valve members. The front and rear suction chambers and the swash plate chamber fluidly communicate by suction passageways formed in the combined cylinder blocks. Similarly, the front and rear discharge chambers fluidly communicate by discharge passageways formed in the combined cylinder blocks.

The outer framework of the refrigerant compressor provided by the above-mentioned combined front and rear cylinder blocks and the front and rear housings must be completely sealed against the atmospheric environment therearound. Further, since the compressor has, in the interior thereof, a low pressure region in which a suction pressure prevails, and a high pressure region in which a high pressure substantially corresponding to the compressed gas pressure prevails, the high and low pressure regions within the compressor must also be appropriately isolated from each other. Thus, gaskets have been suitably incorporated in the compressor and interposed between the respective valve assemblies and housings.

One of the typical gaskets assembled in a generally cylindrical body of a conventional refrigerant compressor is made of a metallic base plate coated with a thin elastic membrane. The typical gasket also includes an outer sealing portion in the shape of a circular rim, and an inner sealing portion in the shape of an annular rim arranged inside the outer sealing portion. The longitudinal ends of the annular, inner sealing portion are curved to extend toward the outer sealing portion and are connected to the latter. The outer sealing portion functions to seal a circumferential region of the outer framework of the compressor against the atmosphere, and the inner sealing portion functions to seal a boundary between the high and low pressure regions within the compressor.

In such a conventional gasket, each of the inner and outer sealing portions is generally provided with an elastically deformable central ridge for a sealing function. FIG. 5 shows the cross-sectional shape of one sealing portion, having a width $W_1$, of the conventional gasket. As shown in FIG. 5 the sealing portion 51 is provided with a central ridge 52 having a width $W_2$, occasionally referred to as "a bead", and a pair of flat side parts 53, 54 integrally joined to the central ridge 52, respectively having widths $W_3$ and $W_4$. The central ridge 52 is formed as a smoothly curved projection projecting from the flat side parts 53, 54 and having an apex 52*a* continuously running along the entire length of the sealing portion 51. The flat side parts 53, 54 also extend along the entire length of the sealing portion 51 to define the peripheral edge of the gasket.

When the sealing portion 51 of the gasket is compressed between two structural members to be sealed, such as the valve plate and the housing of the compressor, the apex 52*a* of the central ridge 52 is closely abutted to one structural member and the surfaces, away from the apex 52*a*, of the flat side parts 53, 54 are closely abutted to another structural member, and thereby a fluid-tight or hermetical sealing is established between the members. At this time, only the central ridge 52 having the width $W_2$, which is the difference between the entire width $W_1$ of the sealing portion 51 and the widths $W_3$, $W_4$ of the side parts 53, 54, is elastically deformed and collapsed under compression to enhance the fluid-tight sealing. That is, the sealing portion 51 is capable of being elastically deformed in only a part "$W_2$" thereof.

It is also known in the art that the gasket with the above-mentioned structure is further provided with plural valve retainers formed integrally with the gaskets, as disclosed in, e.g., Japanese Unexamined Utility Model Publication (Kokai) No. 4-125682. In this gasket, the valve retainers are located, in connection with the respective discharge ports of the valve plate, in the compressor adjacent to the discharge valve member for determining an amount of opening of the discharge valve member.

The gasket including integral valve retainers generally requires a thickness of a metallic base plate of the gasket, sufficient to ensure the mechanical strength of the retainers. Thus, this type of gasket in practical use is made of a metallic base plate having a thickness in the order of 0.6 mm to 1.0 mm, which is generally considered a thicker material used for a soft metallic gasket.

If the gasket made of a metallic base plate having a thickness not less than 0.6 mm includes the sealing portion 51 which includes the central ridge 52 formed partially in width of the sealing portion, significant strength is provided to the central ridge 52 because the width $W_2$ thereof is a little larger than the height $h_1$ between the apex 52*a* and the bottom faces of the side parts 53, 54 (see FIG. 5). As a result, the gasket has a defect in that it is difficult to elastically deform or collapse the central ridge 52, under compression between two structural members to be sealed, to a degree sufficient to establish an effective, stable fluid-tight sealing.

SUMMARY OF THE INVENTION

It is therefore an object of the present invention to provide a metallic base gasket for refrigerant compressors which is improved so as to obviate the defect encountered by the conventional gaskets for refrigerant compressors.

Another object of the present invention is to provide a metallic base gasket, with a thin elastic membrane coating, adapted to be used with refrigerant compressors and exhibiting a stable and good sealing function in every section of the sealing portions thereof.

In accordance with the present invention, there is provided a gasket having a surface thereof coated with an elastic membrane and adapted to be interposed, together with a valve plate and a discharge valve member, between a cylinder block and a housing of a refrigerant compressor under compression, comprising an outer sealing portion for sealing an outer circumference of the compressor against an atmospheric environment therearound; and an inner sealing portion, connected to the outer sealing portion, for sealing between a high pressure region and a low pressure region within the compressor; each of the outer and inner sealing portions including in its entirety a deformable ridge which is shaped as a convexly curved projection with an apex line continuously extending along a length of the each outer and inner sealing portion, the apex line being adapted to be abutted to the housing of the compressor.

In a preferred aspect of the invention, the deformable ridge may have a generally arcuate sectional shape.

In another preferred aspect of the invention, the opposed edges of the deformable ridge, extending along the length of the each outer and inner sealing portion, may define a peripheral edge of the gasket.

In a further preferred aspect of the invention, the gasket may further include at least one retainer extending integrally and radially inward from the inner sealing portion for determining an amount of opening of the discharge valve member, the retainer being bent to project from a remaining portion of the gasket in the same direction as the convexly curved projection defining the deformable ridge of the each sealing portion.

BRIEF DESCRIPTION OF THE DRAWINGS

The above and other objects, features, and advantages of the present invention will become more apparent from the following description of preferred embodiments in connection with the accompanying drawings, in which.

DESCRIPTION OF THE PREFERRED EMBODIMENT

Figure 1:
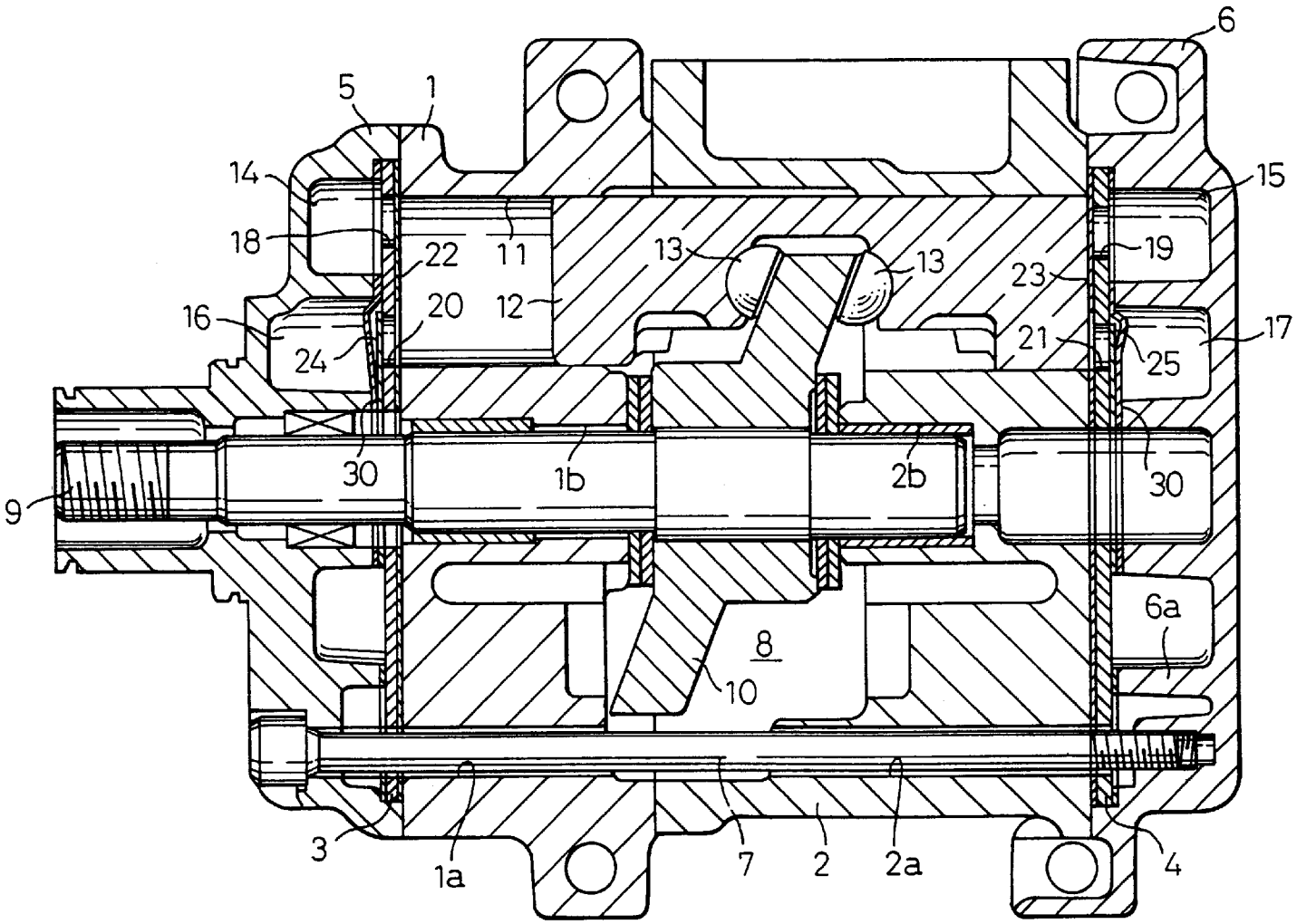
FIG. 1 is a vertical sectional view showing a refrigerant compressor which uses a first embodiment of a gasket according to the present invention.

Referring now to the drawings, in which the same or similar components are denoted by the same reference numerals, FIG. 1 shows a swash plate type refrigerant compressor of the type in which a gasket, provided integrally with a valve retainer, is incorporated.

The swash plate type refrigerant compressor includes axially combined front and rear cylinder blocks 1 and 2 to form a primary part of the body of the compressor. The opposed, front and rear ends of the combined cylinder blocks 1 and 2 are closed by front and rear housings 5 and 6, via front and rear valve assemblies including front and rear valve plates 3 and 4, respectively. The combined cylinder blocks 1, 2, the valve plates 3, 4, and the housings 5, 6 are axially connected by a plurality of long screw bolts 7 which are inserted in through-bores la and 2*a* bored through the combined cylinder blocks 1 and 2.

The combined cylinder blocks 1, 2 are provided with a swash plate chamber 8 centrally formed inside a joint region of the cylinder blocks 1, 2. The swash plate chamber 8 accommodates therein a swash plate 10 which is fixedly mounted on a drive shaft 9 arranged to axially extend through central bores 1*b* and 2*b* of the combined cylinder blocks 1 and 2. The swash plate 10 rotates in the swash plate chamber 10 together with the drive shaft 9 when the drive shaft 9 is rotated.

The combined cylinder blocks 1, 2 are also provided with five axially extended cylinder bores 11 arranged around and in parallel with the drive shaft 9. Radial distances from an axis of rotation of the drive shaft 9 to respective central axes of the five cylinder bores 11 are made equal. Five double headed pistons 12 are slidably fitted inside the respective five cylinder bores 11 to reciprocate therein. Each of the double headed pistons 12 is operatively engaged with the swash plate 10 via a pair of semi-spherical shoes 13. The double headed pistons 12 are reciprocated by the rotating swash plate 10 in the respective cylinder bores 11 to implement suction and compression of the refrigerant gas, and to discharge the compressed refrigerant gas.

The front housing 5 is provided with a front suction chamber 14 formed therein in a radially outer region of the housing 5, and a front discharge chamber 16 formed therein in a radially inner region of the housing 5. The front valve plate 3 is provided with plural front suction bores 18 formed therein for sucking a refrigerant gas before compression from the front suction chamber 14 into respective cylinder bores 11, and plural front discharge bores 20 formed therein for discharging the refrigerant gas after compression from the respective cylinder bores 11 toward the front discharge chamber 16.

The rear housing 6 is provided with a rear suction chamber 15 formed therein in a radially outer region of the housing 6, and a rear discharge chamber 17 formed therein in a radially inner region of the housing 6. The rear valve plate 4 is provided with a plurality of rear suction bores 19 formed therein for sucking a refrigerant gas before compression from the rear suction chamber 15 into respective cylinder bores 11, and a plurality of rear discharge bores 21 formed therein for discharging the refrigerant gas after compression from the respective cylinder bores 11 toward the rear discharge chamber 17.

A suction valve member 22 is interposed between the front end of the combined cylinder blocks 1, 2 and the front valve plate 3, and a discharge valve member 24 and a gasket 30, provided integrally with valve retainers, are interposed between the front valve plate 3 and the front housing 5. A suction valve member 23 is interposed between the rear end of the combined cylinder blocks 1, 2 and the rear valve plate 4, and a discharge valve member 25 and a gasket 30, provided integrally with valve retainers, are interposed between the rear valve plate 4 and the rear housing 6. The suction valve member 22, the front valve plate 3 and the discharge valve member 24 constitute the front valve assembly, and also, the suction valve member 23, the rear valve plate 4 and the discharge valve member 25 constitute the rear valve assembly.

The gasket 30 is an essential component of the present invention, and exhibits an improved function of a fluid-tight sealing established between the front or rear valve plate 3, 4, typically made of a steel, and the front or rear housing 5, 6, typically made of an aluminum, and thus is described in detail below with reference to FIGS. 2 to 4. It should be noted that the gasket 30 is made of a relatively thick, metallic base plate with a thickness in the order of 0.8 mm, coated with an elastic material such as a rubber.

Figure 2:
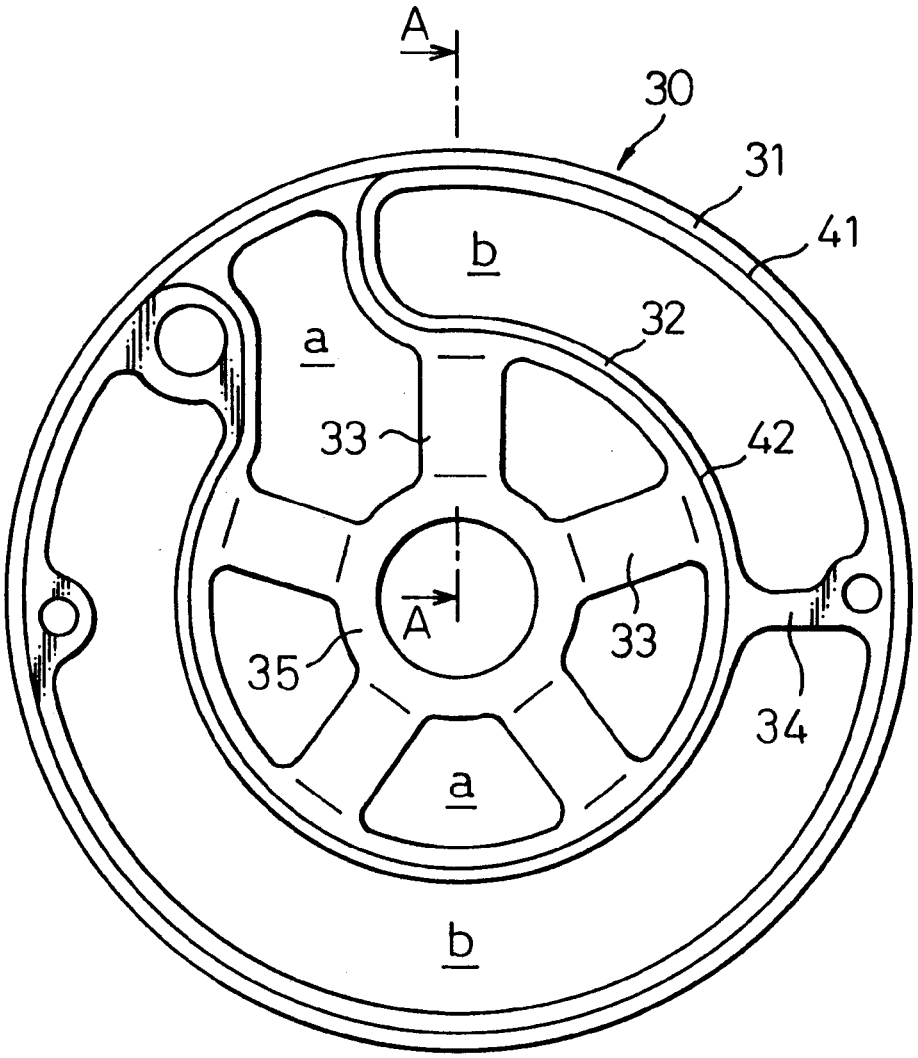
FIG. 2 is a front view of the gasket shown in FIG. 1.
Figure 3:
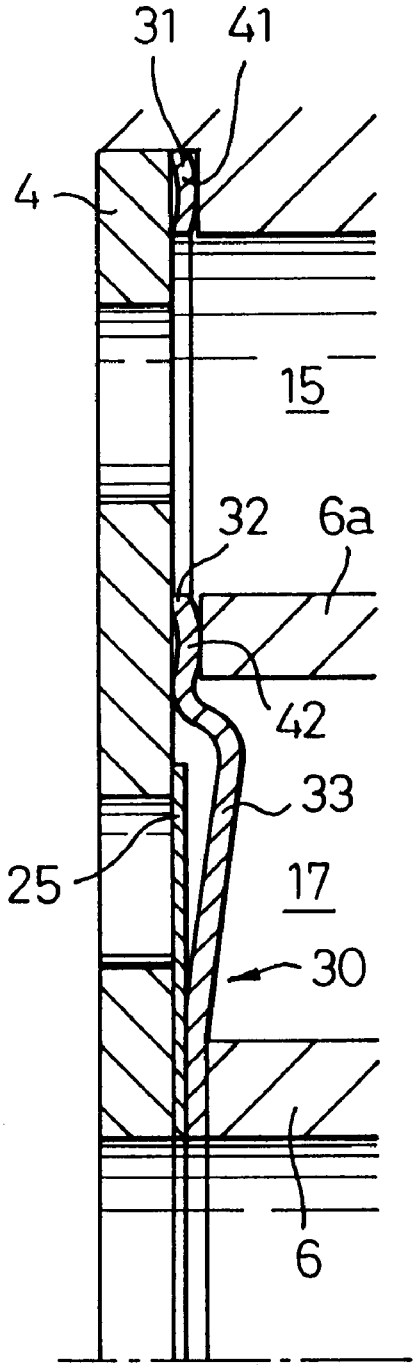
FIG. 3 is an enlarged, vertical sectional view of a part of the compressor of FIG. 1 to clearly show the gasket in an assembled condition, taken along line A-A in FIG. 2.

Referring to FIGS. 2 and 3, the gasket 30 is provided with an outer sealing portion 31, adapted to seal an outer circumference of the refrigerant compressor against the atmosphere, when the gasket 30 is incorporated in the compressor between the front or rear housings 5 or 6 and the front or rear valve plate 3 or 4. Thus, the outer sealing portion 31 is formed as a circular strip having a radial width necessary for sealing the outer circumference of the refrigerant compressor.

The gasket 30 is also provided with an inner sealing portion 32 adapted to seal between a high pressure region "a", corresponding to the discharge chamber 16 or 17 defined in the front or rear housing 5 or 6, and a low pressure region "b", corresponding to the suction chamber 14 or 15 also defined therein. The inner sealing portion 32 is arranged radially inside the outer sealing portion 31 and is formed as an annular strip suitable for sealing between the high and low pressure regions. The longitudinal ends of the annular, inner sealing portion 32 are curved to extend toward the outer sealing portion 31 and are integrally connected to the latter. One additional reinforcing rim 34 integrally connecting the outer and inner sealing portion 31 and 32 with each other is shown in FIG. 2.

The outer and inner sealing portions 31 and 32 are provided in their entirety with continuous and elastically deformable ridges 41 and 42, respectively, to enhance the fluid-tight or hermetical sealing properties of the gasket 30. Each of the ridges 41, 42 is formed as a convexly curved projection having an apex (only the apex 42*a* of the ridge 42 is shown in FIG. 4) continuously running along the entire length of each of the sealing portions 31, 32. FIG. 2 illustrates such a continuous apex by a continuously extending solid line, and thus, the line will be referred to as "an apex line" throughout the description and appended claims.

The gasket 30 further includes five radial ribs 33 formed integrally between an innermost, center rim 35, which also has a sealing function but does not have a ridge, and the annular inner sealing portion 32. Each of the radial ribs 33 is bent as shown in FIG. 3 to function as a valve retainer for determining an amount of opening of the discharge valve member 25. It should be noted that the radial rib 33 is bent to project from the remaining portion of the gasket 30 in the same direction, or the same side, as the convexly curved projection defining the ridge 42 of the inner sealing portion 32.

The ridges 41, 42 of the respective sealing portions 31, 32 of the gasket 30 have an essentially identical structure to each other, and thus the ridge 42 of the inner sealing portion 32 is representatively described in more detail below with reference to FIG. 4.

Figure 4:
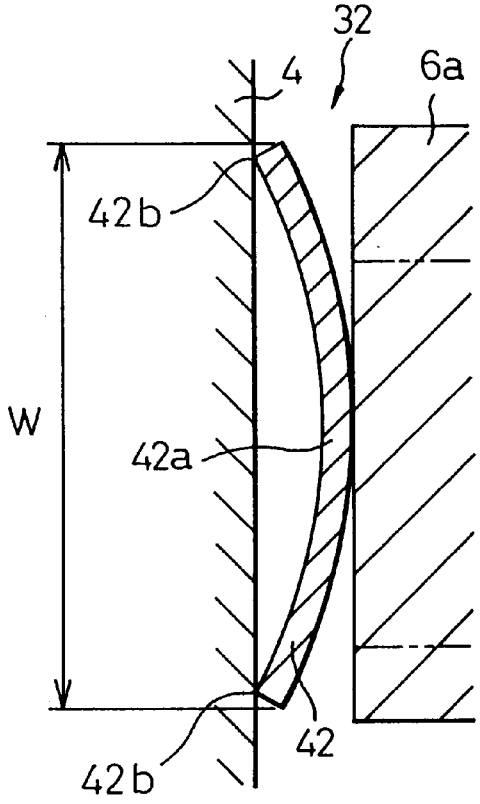
FIG. 4 is an enlarged, vertical sectional view of a sealing portion of the gasket to clearly show the abutted state thereof between two structural members.

FIG. 4 schematically shows only the inner sealing portion 32 of the gasket 30 which is interposed between the rear valve plate 4 and the rear housing 6 as illustrated in FIG. 3. The inner sealing portion 32 is tightly held between the rear valve plate 4 and a partition wall 6*a* of the rear housing 6, the partition wall 6*a* being formed integrally with the rear housing 6 to separate the rear suction chamber 15 from the rear discharge chamber 17.

The ridge 42 of the inner sealing portion 32 has a generally arcuate sectional shape, and extends over the entire width W of the sealing portion 32, the width W being sufficient to exhibit a good sealing function between the rear valve plate 4 and the partition wall 6*a*. Thus, the opposed edges 42*b* of the ridge 42, extending along the length of the inner sealing portion 32, define a peripheral edge of the inner sealing portion 32.

When the inner sealing portion 32 is compressed between the rear valve plate 4 and the partition wall 6*a*, the apex line defined by the apex 42*a* of the ridge 42 is closely abutted to the partition wall 6*a* and the opposed edges 42*b* of the ridge 42 are closely abutted to the valve plate 4, and thereby a fluid-tight sealing is established therebetween. At this time, the ridge 42 having the entire width W of the sealing portion 32 is elastically deformed and collapsed under compression to enhance the fluid-tight sealing. That is, the inner sealing portion 32 is capable of being elastically deformed over the entire width W thereof.

Figure 5:
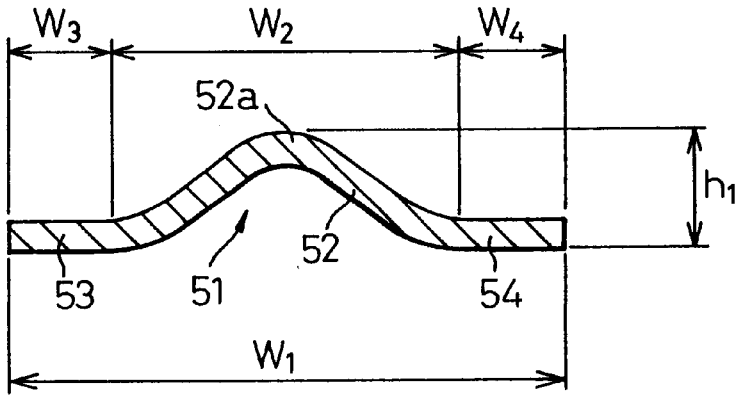
Fig. 5 PRIOR ART
FIG. 5 schematically shows in cross-section a sealing portion of a conventional gasket for a refrigerant compressor.

In this arrangement, because the width W of the ridge 42 is significantly larger than the height thereof defined between the apex 42*a* and the opposed edges 42*b*, the ridge 42 is more readily deformed and collapsed under compression between the rear valve plate 4 and the partition wall 6*a*, in comparison with the conventional structure with the central ridge 52 and the flat side parts 53, 54 as shown in FIG. 5. This characteristic feature and an advantage thereof are quite identically obtained in the outer sealing portion 31 of the gasket 30.

Therefore, in the gasket 30, even when the gasket 30 is made of a relatively thick metallic base plate to ensure the mechanical strength of the valve retainers, the ridges 41 and 42 of the outer and inner sealing portions 31 and 32 are capable of being readily elastically deformed and collapsed over the entire width thereof, and thus of exhibiting a large elastic restoring force sufficient to establish an effective, stable fluid-tight sealing of the sealing portions 31, 32.

Further, in the above embodiment, when each of the gaskets 30 is interposed in a proper orientation between the front or rear valve plate 3, 4 and the front or rear housing 5, 6, the apex lines of the ridges 41, 42 of the respective sealing portions 31, 32 are abutted to the predetermined inner wall surfaces of the front or rear housing 5, 6. Consequently, even if the wall of the front or rear housing, e.g., the partition wall 6*a* of the rear housing 6, is thinned for the purpose of the reduction of size or weight of the compressor (as shown in a dashed line in FIG. 4), the apex lines of the ridges 41, 42 of the respective sealing portions 31, 32 of each gasket 30 are maintained in an appropriate contact condition against the inner wall surface of the front or rear housing, and thus the effective, stable fluid-tight sealing of the sealing portions 31, 32 of the gasket 30 is fully ensured.

While the invention has been particularly shown and described with reference to preferred embodiments thereof, it will be understood by those skilled in the art that various changes and modifications may be made without departing from the spirit and scope of the invention. The scope of the invention is therefore to be determined solely by the appended claims.

What is claimed is:

1. A metallic gasket having a surface thereof coated with an elastic membrane for mounting, together with a valve plate and a discharge valve member, between a cylinder block and a housing of a refrigerant compressor, comprising:

an outer sealing portion for sealing an outer circumference of the compressor; and an inner sealing portion, connected to said outer sealing portion, for sealing between a high pressure region and a low pressure region within the compressor;

each of said outer and inner sealing portions including a deformable ridge which extends over an entire width of each outer and inner sealing portion, said ridge being shaped as a convexly curved projection with an apex line continuously extending along a length of said each outer and inner sealing portion, said apex line being adapted to be abutted to the housing of the compressor wherein opposed edges of said deformable ridge, extending along the length of said each outer and inner sealing portion, define a peripheral edge of said gasket.

2. The gasket of claim 1, wherein said deformable ridge has a generally arcuate sectional shape.

3. The gasket of claim 1, further including at least one retainer extending integrally and radially inward from said inner sealing portion for determining opening of said discharge valve member, said retainer being bent to project from a remaining portion of said gasket in the same direction as said convexly curved projection defining said deformable ridge of said each sealing portion.

* * * * *